United States Patent [19]

Piriz

[11] Patent Number: 5,015,195

[45] Date of Patent: May 14, 1991

[54] PLUG AND SOCKET ELECTRICAL CONNECTION ASSEMBLY

[75] Inventor: Jose M. Piriz, Hillside, N.J.

[73] Assignee: Thomas & Betts Corporation, Bridgewater, N.J.

[21] Appl. No.: 492,503

[22] Filed: Mar. 13, 1990

[51] Int. Cl.[5] ..... H01R 4/54

[52] U.S. Cl. ..... 439/318; 439/825; 439/750; 439/272

[58] Field of Search ..... 439/884, 889, 660, 670, 439/671, 693, 692, 271, 586, 587, 588, 738, 310, 314–319, 272, 273, 278, 283, 825, 750, 272

[56] References Cited

U.S. PATENT DOCUMENTS

| | | | |
|---|---|---|---|
| 3,321,733 | 5/1967 | Thomas | 439/314 |
| 3,673,541 | 6/1972 | Volinskie | 439/271 |
| 4,299,431 | 11/1981 | Wilson et al. | 439/205 |

FOREIGN PATENT DOCUMENTS

| | | | |
|---|---|---|---|
| 372361 | 11/1963 | Switzerland | 439/588 |

*Primary Examiner*—David L. Pirlot

*Attorney, Agent, or Firm*—Robert M. Rodrick; Salvatore J. Abbruzzese

[57] ABSTRACT

A plug and socket electrical connection assembly for electrically connecting a pair of cables is disclosed. The connection assembly includes a socket connector adapted to be terminated to one cable of the pair and an elongate plug connector adapted to electrically terminated the other cable of the pair. A plug extent of the plug connector is designed for insertion into a socket extent of the socket connector to establish electrical connection therebetween. A deformable electrically insulative wiping element is attached to the front of the plug extent. The wiping element is dimensioned to snugly fit within the socket extent to wipe any debris or contamination therefrom upon insertion of the plug connector into the socket connector.

16 Claims, 2 Drawing Sheets

PLUG AND SOCKET ELECTRICAL CONNECTION ASSEMBLY

FIELD OF INVENTION

This invention relates generally to an electrical connection assembly. More particularly, the present invention relates to a plug and socket electrical connection assembly which electrically interconnects a pair of electrical cables.

BACKGROUND OF THE INVENTION

Plug and socket electrical connectors are widely used to interconnect electrical cables terminated thereto. Typically, the socket connector, terminated to one electrical cable, includes an open socket portion providing interconnection access. The plug connector, terminated to another electrical cable, includes an extending portion configured to fit into the socket portion of the socket connector, establishing electrical connection therebetween. In many instances the plug and socket connector is locked in connected position preventing accidental disconnection.

The basic principal of the plug and socket connectors is used in every day applications such as household power receptacles and telephone connections. However, the basic plug and socket connection scheme may also be used to interconnect higher voltage power cable used outdoors, underground or in other environments in which the components may be exposed to contaminants, debris, and other conditions adverse to the electrical interconnection. The socket portion of the socket connector is especially susceptible to attracting and retaining debris and other contaminants thereon which would interfere with establishing electrical continuity with the plug connector inserted therein.

There have been various attempts to alleviate the problem of connector contamination. In many instances, the user must manually clean the connector components prior to interconnection. This, of course, requires a separate step each time a connection is made. Additionally, covers have been developed, which enclose an electrical connector, preventing the connector from becoming contaminated. This technique requires employing additional parts, and also requires the user to properly install the cover to insure effectiveness. It is therefore desirable to provide a connection assembly which, without the requirement of additional parts, would provide a clean connection surface free from contaminants for the interconnection of a plug and socket connector. Further, this assembly should be easy to use in the field, and require minimal installation time. Also, this assembly should provide locking means for securing one component to the other, avoiding inadvertent disconnection.

SUMMARY OF THE INVENTION

It is an object of the present invention to provide a plug and socket electrical connection assembly which provides for the effective interconnection of a plug connector and a socket connector free from adverse affects of environmental contamination.

It is a further object of the present invention to provide a plug and socket connection assembly which permits the locking engagement of the plug connector within the socket connector, preventing inadvertent disconnection.

It is a still further object of the present invention to provide a plug and socket electrical connection assembly for connecting a pair of electrical cables, which is easily field-installable and which employs a minimal number of additional parts to simplify such field installation.

In the efficient attainment of these and other objects, the present invention provides a plug and socket assembly for electrically interconnecting a pair of electrical cables The assembly of the present invention includes an elongate socket connector, having one end which is adapted to be electrically connected to one cable of the pair and an opposed end having an open-ended socket bore. The assembly further includes an elongate plug connector, having one end adapted to be electrically interconnected to the second cable of the pair and an opposed plug extent which is configured to be insertably received within the socket bore to thereby establish electrical connection between the plug and socket connector. The plug connector further includes a deformable electrically insulative wiping element attached to the end of the plug extent. The wiping element is dimensioned to snugly fit within the socket bore to provide a wiping action within the socket bore, to wipe the socket clear of any dirt, debris or contaminants, which may have accumulated therein and which could adversely affect the interconnection.

As shown by way of the preferred embodiment, the socket bore is cylindrical, having an inner diameter defined by a cylindrical side wall. The plug extent is also cylindrical, having an outer diameter defined by a plug side wall. The plug is insertable into the socket to establish electrical connection between the respective side walls. The wiping element includes an elongate cylindrical body having circumferential skirt means extending outwardly therefrom to provide wiping engagement against the cylindrical side walls of the bore of the socket.

Additionally, the socket connector and the plug connector include cooperative locking means for locking the plug connector to the socket connector. This cooperative locking means includes a bayonet coupling, operable under the bias of a spring. The wiping element is formed from deformable electromeric material and provides the spring bias necessary to effect the bayonet coupling.

DETAILED DESCRIPTION OF THE PREFERRED EMBODIMENT

Figure 1:
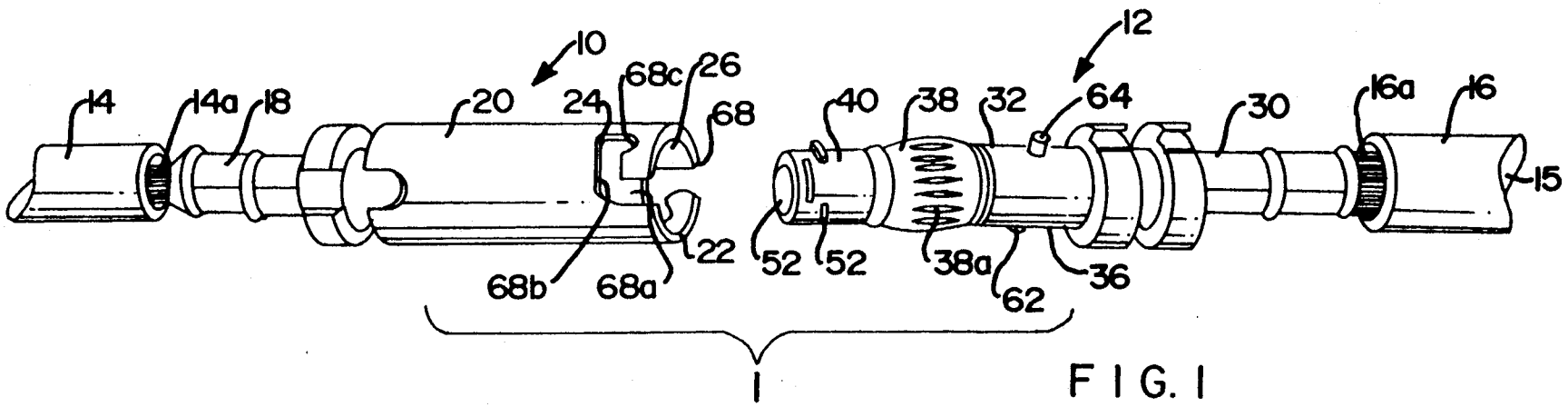
FIG. 1 is a perspective showing of the connection assembly of the present invention, including a socket connector and a plug connector, each terminated to an insulated electrical cable.
Figure 2:
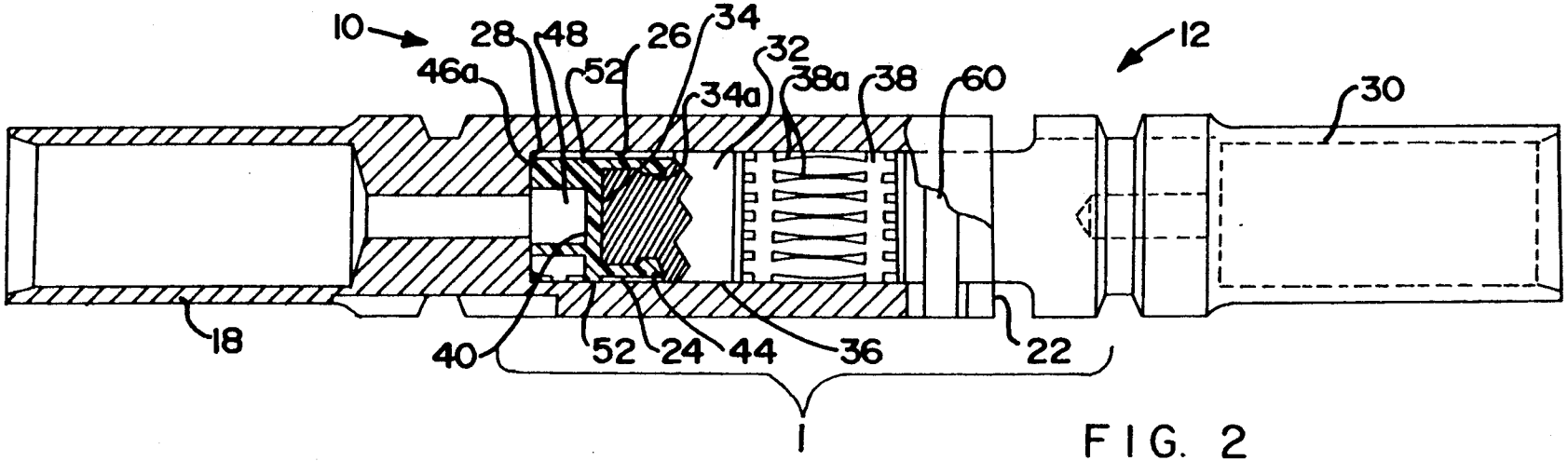
FIG. 2 shows in partial vertical section, the interconnected plug connector and socket connector of FIG. 1.

Referring to FIGS. 1 and 2, an electrical connection assembly 1 of the present invention is shown. Connection assembly 1 includes a socket connector 10 and a plug connector 12, each terminating respectively insulated electrical cables 14 and 16.

Cables 14 and 16 may be any type of electrical cables, each of which have a bared end extent 14*a* and 16*a* exposed for electrical connection purposes. Typically, cables 14 and 16 used in combination with the present invention are power cables, which may be run outdoors, underground or in open factory areas where the cables may be exposed to adverse contaminants such as debris, oil, grease or other elements which could adversely affect exposed electrical elements.

Socket connector 10 is an elongate metallic member having generally a cylindrical shape. Socket connector 10 is typically formed from copper barstock. As formed, socket connector 10 has a barrel end 18 for receiving the exposed portion 14*a* of electrical cable 14 which may be crimped thereto in conventional fashion. Socket connector 10 further includes a socket extent 20 having an open end 22 and a cylindrical bore 24 therein defined by an internal cylindrical side wall 26. As shown in FIG. 2, bore 24 is further defined by a bottom wall 28 opposite open end 22 of socket extent 20.

Plug connector 12 is also an elongate cylindrical member typically formed from copper barstock. Plug connector 12 includes a barrel end 30, for accommodating exposed portion 16*a* of cable 16 which may be crimped thereto in conventional fashion. Plug connector 12 further includes a plug extent 32 having a front end 34 (FIG. 2) and a cylindrical side wall 36 extending rearwardly from front end 34.

As shown particularly in FIG. 2, socket connector 10 and plug connector 12 are constructed to provide surface-to-surface contact between side wall 36 of plug connector 12 and side wall 26 of socket connector 10. The inner diameter of bore 24 of socket connector 10 is dimensioned closely to the outer diameter of plug extent 32 so that plug extent 32 fits snugly within bore 24 of socket extent 20.

To facilitate the electrical interconnection of plug connector 12 with socket connector 10, plug connector 12 includes a centrally located outwardly extending circumferential spring contact strip 38. Spring contact strip 38 includes louvered contact fingers 38*a* which slidingly and deformably engage side wall 26 of bore 24 upon insertion of plug connector 12 into socket connector 10. This enhances electrical connection therebetween. Spring contact strip 38 is of the type commercially sold for use with plug and socket connectors under the trademark MULTILAM and is shown and described in U.S. Pat. Nos. 3,161,451 and 4,453,587.

Figure 4:
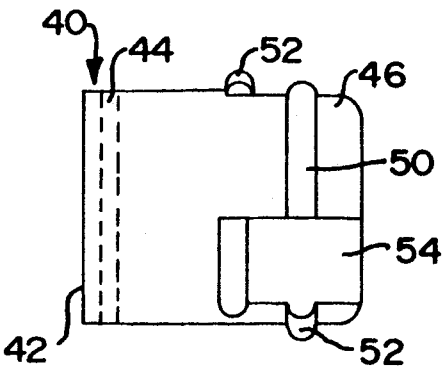
FIGS. 3 and 4 show in front plan and side elevational showings respectively, the wiping element of the plug connector of FIG. 1.
Figure 3:
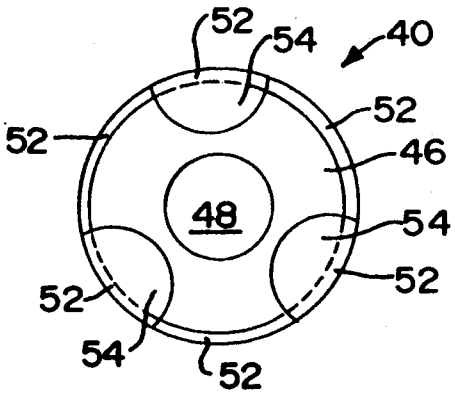

Referring additionally to FIGS. 3 and 4, plug connector 12 further includes a wiping element 40 attached to the front end 34 thereof. Wiping element 40 is an elongate generally cylindrical member formed of an electrically insulative elastomeric material, such as neoprene. As shown in FIG. 2, wiping element 40 includes a rear portion 42, which is designed to snap onto front end 34 of plug extent 32 to secure wiping element 40 thereto. An annular rib 44 is seated in an annular recess 34*a* of front end 34 to provide snap securement of wiping element 40 on plug extent 32. Wiping element 40 further includes a front portion 46 opposite rear portion 42. Front portion 46 is generally cup shaped, having an open ended cavity 48 adjacent the front end thereof. Cavity 48 permits front portion 46 to be resiliently deformed upon engagement with bottom wall 28 of socket extent 20 as will be described in further detail hereinbelow. Wiping element 40 is designed and positioned to engage side wall 26 of bore 24 upon insertion of plug extent 32 thereinto. The engagement of wiping element 40 with side wall 26 serves to wipe debris, oil, grease or other contaminants from the surface of side wall 26 to thereby provide a clean surface for engagement with the louvers 38*a* of contact strip 38.

In order to provide complete circumferential cleaning of cylindrical side wall 26, wiping element 40 includes circumferential skirt means 50, adjacent front portion 46 thereof. Skirt means 50 includes plural radially extending arcuate skirt elements 52. Each of skirt elements 52 traverse an arc around wiping element 40, which is less than the total circumference thereof. As particularly shown in FIGS. 3 and 4, circumferentially adjacent skirt members 52 are longitudinally spaced from each other, providing thereby an air passage within bore 24. Since skirt elements 52 snugly engage side wall 26 of bore 24, plug extent 32 functions as a piston, compressing air within bore 24, rendering further insertion difficult. The arrangement of skirt elements 52 permits the compressed air to be expelled.

In order to further facilitate the escape of air upon insertion of plug extent 32 into bore 24, front portion 46 of wiping element 40 includes side channels 54. Side channels 54 extend from the front portion 46 of wiping element 40 longitudinally toward rear portion 42 and are spaced between arcuate skirt elements 52. Side channels 54 together with skirt elements 52 provide for passage of air compressed during insertion of plug extent 32 into socket extent 20 and thereby reduce the pistoning effect caused by such insertion. In the present embodiment three circumferentially spaced side channel 54 are shown. Also, skirt means 50 is divided into six circumferentially spaced skirt elements 52. However, any suitable arrangement of skirt elements and side channels serving the same function may be employed.

In order to effectively secure plug connector 12 to socket connector 10, cooperative locking means is provided by way of interfitting bayonet couplings. Bayonet couplings similar to the type described herein are well-known and typically used to couple connector components.

Referring to FIGS. 1 and 2, plug connector 12 includes at a central location along plug extent 32, a transversely extending pin 60. Pin 60 includes pin end extents 62, which extend radially outwardly from plug extent 32. As part of the bayonet coupling, socket connector 10 includes, adjacent the open end of socket extent 20, a pair of diametrically opposed pin receiving channels 66. Pin receiving channels 66 each include a first longitudinal passage 66*a*, a transverse passage 66*b* in communication with passage 66*a* and a second longitudinal passage 66*c* extending toward the open end 22 of socket extent 20.

The bayonet coupling works in the following manner. As plug extent 32 is inserted into bore 24 along axis 15, each of pin end extents 62 is inserted into first longitudinal passage 66*a*. Plug connector 12 is then rotated slightly about axis 15, so that each pin end extent 62 rides in transverse passage 66*b*. Then, under the bias of a spring element (described hereinbelow) pin end extent 62 is pulled back into second longitudinal passages 66*c* to lock plug extent 32 in socket bore 24.

In conventional bayonet coupling devices a separate spring element is typically employed to provide the spring force necessary to lock the pin end extents in the pin receiving channels. The present invention eliminates the need for a separate spring element by employing the resiliently deformable wiping element 40 as the spring necessary to operate the bayonet coupling.

As referred to above, wiping element 40 includes a front portion 46 having a cavity 48, which reduces the transverse thickness of front portion 46. Further as wiping element 40 is formed of a resiliently deformable material, upon insertion of plug extent 32 into socket extent 20, a front wall 46a of front portion 46 engages bottom wall 28. Further inward movement of plug connector 12 with respect to socket connector 10 will deform front portion 46, permitting movement of pin end extents 62 through first longitudinal passages 68a. Upon axial rotation of plug connector 12, pin end extents 62 will be positioned within second longitudinal passages 68b. The natural resiliency of front portion 46 of wiping element 40 will force plug extent 32 longitudinally backwards, thereby locking pin end extents 62 in second longitudinal passage 66c. Thus, wiping element 40 serves the additional function of the spring biasing element for the bayonet coupling.

Figure 5:
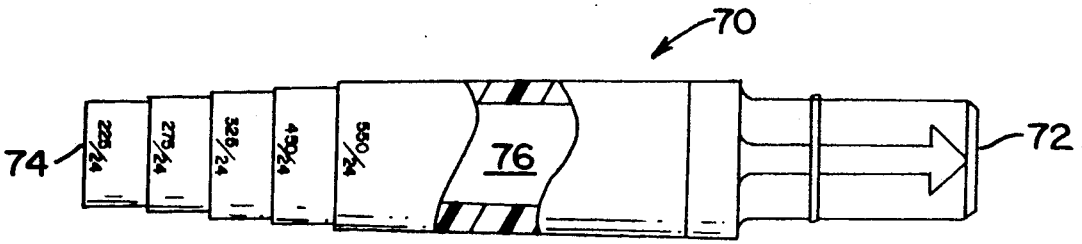
FIG. 5 is a side elevational showing partially in section of a splash-proof boot used in combination with the socket connector shown in FIG. 1.
Figure 6:
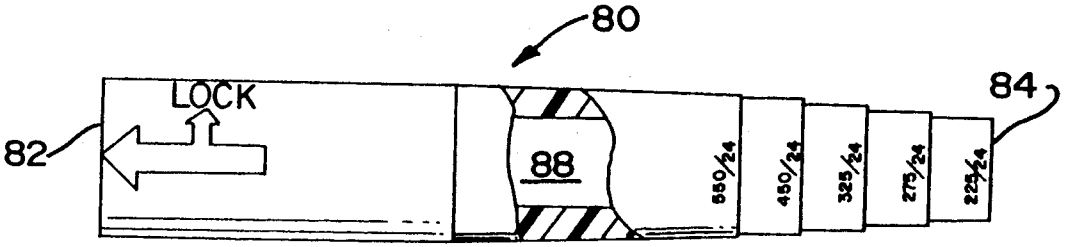
FIG. 6 is a side elevational view, partially in section, of a splash-proof boot used in combination with the plug connector shown in FIG. 1.

A further feature of the present invention is shown in FIGS. 5 and 6. As mentioned above, connection assembly 1 (FIG. 1) is typically used in adverse environments where the components may be exposed to debris, grease or other contaminants. Additionally, the connection assembly 1 may be exposed to water. To additionally protect the connection assembly 1, the present invention contemplates use of a two part protective splashproof boot, shown in FIGS. 5 and 6.

Boot 70, shown in FIG. 5, is an elongate member formed of elastomeric material. Boot 70 has opposed open ends 72 and 74 and a central channel 76 which supports therein socket connector 10 shown in FIG. 1. End 74 is tapered in incremental fashion to tightly engage electrical cable 14 providing sealed engagement therewith. The incrementally tapered end 74 may be cut at various locations therealong to provide engagement with cables of differing diameter. End 72 is open, permitting interconnection access to socket connector 10 supported therein.

A similar boot 80 is shown in FIG. 6 for supporting plug connector 12. Boot 80 is substantially similar to boot 70, having opposed open ends 82 and 84 and a central channel 88 therebetween. The inner diameter of boot 88 adjacent front end 82 is dimensioned to accommodate end 72 of boot 70, upon interconnection of plug connector 12 and socket connector 10. Thus when fully connected, connection assembly 1 is adequately sealed from adverse elements. Also, water penetration is prevented.

Additionally, as boots 70 and 80 cover socket connector 10 and plug connector 12 respectively, they provide electrical insulation to each connector supported therein. Thus, when in the unconnected position, if the cable attached to either plug connector 12 or socket connector 10 is inadvertently energized, the metallic connectors themselves will not be susceptible to accidental contact with the user. In the case of plug connector 12, wiping element 40 provides a "dead front" to the connection assembly, so that even the front end 34 of plug connector 12 is not exposed to the user.

Various changes to the foregoing described and shown structures would now be evident to those skilled in the art. Accordingly, the particularly disclosed, scope of the invention is set forth in the following claims.

I claim:

1. A plug and socket assembly for electrically interconnecting a pair of electrical cables, said assembly comprising:

an elongate socket connector having a termination extent adapted to be electrically connected to one cable of said pair and an opposed socket extent, said socket extent having an elongate open ended bore therein being defined by a bottom wall and a longitudinal bore side wall;

an elongate plug connector having a termination extent adapted to be electrically connected to the second cable of said pair and an opposed plug extent, said plug extent being defined by a front wall and a longitudinal plug side wall extending rearwardly therefrom, said plug extent being insertible into said socket bore to establish electrical connection between said bore side wall and said plug side wall and thereby establishing electrical connection between said pair of electrical cables; and an axially deformed electrically insulative wiping element attached to the front wall of said plug extent, said wiping element being dimensioned for snugly fitting within said socket bore and slidably engaging said bore side wall upon said insertion of said plug extent thereinto.

2. An assembly of claim 1 further including:

a first elongate sealing housing formed of elastomeric material having a cable receiving open end, an opposed open connection end and a cavity therebetween which accommodates said socket connector; and a second elongate sealing housing formed of elastomeric material having a cable receiving open end an opposed connection end and a cavity therebetween which accommodates said plug connector;

wherein said open connection ends of each of s aid first and second housings are interengagable in a sealing relationship upon insertion of said plug extent into said socket bore.

3. An assembly of claim 1 when said socket bore is cylindrical having an inner diameter defined by said bore side wall and when said plug extent is cylindrical having an outer diameter defined by said plug side wall, said plug extent being insertibly received in said socket bore along a common central axis.

4. An assembly of claim 3 wherein said wiping element includes an elongate cylindrical body and circumferential skirt means extending outwardly therefrom for wiping engagement with said side wall of said socket bore.

5. An assembly of claim 4 wherein said circumferential skirt means includes plural arcuate skirt elements, each skirt element traversing an arc less than the total circumference of said cylindrical body, one of said skirt elements being located at a position longitudinally spaced from another skirt element.

6. An assembly of claim 5 wherein said wiping element includes an elongate channel extending from one end of said cylindrical body, said channel extending between longitudinally spaced skirt elements.

7. An assembly of claim 6 wherein said socket connector and said plug connector include cooperative looking means for locking said plug connector to said socket connector.

8. An assembly of claim 7 wherein said locking means includes bayonet connection elements interengagable under the bias of spring.

9. An assembly of claim 8 wherein said spring includes said deformable wiping element.

10. An assembly of claim 9 wherein said wiping element cylindrical body is longitudinally resiliently compressible.

11. An assembly for electrically interconnecting a pair of electrical cables comprising:

a socket connector for terminating one cable of said pair, said socket connector including an elongate open ended socket bore having a bottom wall and a longitudinal bore side wall;

a plug connector for terminating the other cable of said pair, said plug connector including an elongate plug extent having a front wall and a longitudinal plug side wall, said plug extent being insertable into said socket bore to establish electrical connection therebetween;

bayonet locking means for securing said plug connector to said socket connector, said bayonet locking means being operable under a spring bias; and a resiliently deformable wiping element secured to said front wall of said plug extent and deformably engagable with said side wall and said bottom wall of said socket bore upon insertion of said plug extent into said socket bore, said resiliant deformation of said wiping element providing said bayonet locking means operable spring bias.

12. An assembly of claim 11 wherein said wiping element includes extending skirt means slidably engagable with said bore side wall upon insertion of said plug extent into said socket bore.

13. An assembly of claim 12 wherein said socket connector and said plug connector are formed from conductive metal and wherein said wiping element is formed from electrically insulative material.

14. An assembly of claim 13 further including:

a first elongate-sealing boot positionable over said socket connector, said first sealing boot having an open end adjacent said socket bore; and a second elongate sealing boot positionable over said plug connector, said second sealing boot having an open end adjacent said plug extent front wall.

15. An assembly of claim 14 wherein said first sealing boot engages said second sealing boot adjacent said open ends thereof in sealed relationship upon said insertion of said plug extent into said socket bore.

16. A plug and socket assembly for electrically interconnecting a pair of electrical cables, said assembly comprising:

an elongate socket connector having a termination extent adapted to be electrically connected to one cable of said pair and an opposed socket extend, said socket extent having an elongate open ended cylindrical bore therein being defined by a bottom wall and a longitudinal bore side wall;

an elongate plug connector having a termination extent adapted to be electrically connected to the second cable of said pair and an opposed cylindrical plug extent, said plug extend being defined by a front wall and a longitudinal plug side wall, said plug extent being insertable into said socket bore along a common central axis to establish electrical connection between said bore side wall and said plug side wall and thereby establishing electrical connection between said pair of electrical cables; and a deformable electrically insulative wiping element attached to the front wall of said plug extent, said wiping element including an elongate cylindrical body and circumferential skirt means extending outwardly therefrom for wiping engagement with said side wall of said socket bore upon insertion of said plug extent thereinto.

* * * * *